US005390621A

United States Patent [19]

Hattori et al.

[11] Patent Number: 5,390,621

[45] Date of Patent: Feb. 21, 1995

[54] WATERCRAFT

[75] Inventors: Toshiyuki Hattori; Fumihiko Ebihara, both of Iwata, Japan

[73] Assignee: Yamaha Hatsudoki Kabushiki Kaisha, Iwata, Japan

[21] Appl. No.: 113,857

[22] Filed: Aug. 30, 1993

Related U.S. Application Data

[60] Continuation-in-part of Ser. No. 79,899, Jun. 21, 1993, Pat. No. 5,355,826, which is a division of Ser. No. 786,536, Nov. 1, 1991, Pat. No. 5,255,626.

[30] Foreign Application Priority Data

Sep. 1, 1992 [JP] Japan ..... 4-233716
Sep. 1, 1992 [JP] Japan ..... 4-233717

[51] Int. Cl.[6] ..... B63B 35/73

[52] U.S. Cl. ..... 114/270; 114/56; 114/211; 114/290; 114/361

[58] Field of Search ..... 114/50, 144 R, 270, 114/288, 361, 290, 211, 271, 56; 440/88

[56] References Cited

U.S. PATENT DOCUMENTS

| | | | |
|---|---|---|---|
| 2,234,899 | 3/1941 | Higgins | 114/290 |
| 2,249,958 | 7/1941 | Inwood | 114/56 |
| 3,158,129 | 11/1964 | Mauer | 114/270 |
| 3,397,670 | 8/1968 | Bedford | 114/270 |
| 3,483,844 | 12/1969 | Trautwein | 114/270 |
| 3,756,189 | 9/1973 | Yutzler | 114/270 |
| 3,826,220 | 7/1974 | Jacobsen | 114/270 |
| 3,948,206 | 4/1976 | Tyler | 114/270 |
| 4,337,544 | 7/1982 | Coulter et al. | 114/56 X |
| 4,760,810 | 8/1988 | Kobayashi | 114/56 |
| 4,768,983 | 9/1988 | Smith | 440/111 |
| 4,893,579 | 1/1990 | Kobayashi | 114/363 |
| 4,945,852 | 8/1990 | Kobayashi | 114/363 |
| 4,984,528 | 1/1991 | Kobayashi | 440/88 |
| 4,986,208 | 1/1991 | Kobayashi | 114/144 R |
| 5,097,789 | 3/1992 | Oka | 114/363 |
| 5,255,626 | 10/1993 | Hattori et al. | 114/270 |

FOREIGN PATENT DOCUMENTS

| | | | |
|---|---|---|---|
| 61-291292 | 12/1986 | Japan . | |
| 62-12589 | 6/1987 | Japan . | |
| 0218299 | 9/1987 | Japan | 440/88 |
| 2-85090 | 3/1990 | Japan . | |
| 3-99995 | 4/1991 | Japan . | |

*Primary Examiner*—Sherman Basinger
*Attorney, Agent, or Firm*—Knobbe, Martens, Olson & Bear

[57] ABSTRACT

A hull configuration for a small personal watercraft having a hull configuration that permits the watercraft to be ridden and leaned like a motorcycle and which will preclude excess spray from passing upward beyond the gunnel. A ventilating cover assembly is provided for accessing the engine compartment and a forwardly positioned fuel tank is incorporated having a filler neck that is accessible at one side of the deck.

41 Claims, 13 Drawing Sheets

WATERCRAFT

CROSS-REFERENCE TO RELATED APPLICATIONS

This application is a continuation-in-part of our application Ser. No. 079,899, filed Jun. 21, 1993, U.S. Pat. No. 5,355,826, of the same title, which application is a division of our application of the same title, Ser. No. 786,536, filed Nov. 1, 1991, now issued as U.S. Pat. No. 5,255,626 on Oct. 26, 1993 which applications and Patents are all assigned to the Assignee hereof.

BACKGROUND OF THE INVENTION

This invention relates to a watercraft and more particularly to a small personal type of watercraft designed to be operated by a single rider seated in a partially standing position and having a sporting nature that permits the watercraft to be leaned like a motorcycle but which provides good stability. Specifically, the invention relates to an improved hull configuration for such a watercraft, a configuration of the hull that permits ventilation of the engine compartment and a fuel tank and filler arrangement for such a watercraft.

In the watercraft of the types described in the aforenoted co-pending applications, the disclosures of which are incorporated herein by reference, the hull configuration is particularly important in providing a hull configuration that will have straight ahead stability, will allow the rider to lean the watercraft and which will also have sufficient stability that once the watercraft is leaned more than a certain extent, it will become stable.

In order to maintain sporting performance for such watercraft, it is desirable to insure that the hull is quite compact and short in length. Also, although these types of watercraft are quite sporting in their nature, it is also desirable to insure that the wake or spray caused by the motion of the watercraft when passing through the water does not discharge upwardly in front of the rider or passengers. In addition to the disadvantages of getting the rider and passengers overly wet, the forward discharge of the spray will obscure the visibility. Of course, it is easy to provide an arrangement that will redirect the spray away from the front of the watercraft, but the constructions previously proposed for this purpose have necessitated long hulls, which is undesirable for the reasons as aforenoted.

It is, therefore, a principal object to this invention to provide an improved hull configuration for such a small watercraft that provides a compact construction and, at the same time, will cause the spray to be redirected away from the front of the watercraft so as to not obscure the rider's vision or cause a loss of buoyancy.

With this type of watercraft it is the normal practice to provide an engine compartment which is either beneath or immediately forward the rider's area and in which the powering internal combustion engine is positioned. This type of watercraft is frequently powered by a jet propulsion unit that is mounted in a tunnel at the rear of the watercraft and normally beneath the seat or the rider's area. With such an arrangement, it is desirable that the engine compartment can be readily accessed and yet that the engine compartment be relatively tightly sealed from water so as to preclude the entry of large amounts of water into the engine compartment where it might damage the engine. However, it is also necessary to provide adequate air flow to the engine compartment not only as combustion air for the engine but also so as to ventilate the engine compartment and avoid the accumulation of undesirable gases in the engine compartment.

Although a wide variety of ventilation systems have been proposed for such watercraft, these systems tend to become complicated, require a large number of parts and interfere with the access to the engine compartment.

It is, therefore, a still further object to this invention to provide an improved ventilating system for a small watercraft.

It is a further object to this invention to provide a ventilating system for a small watercraft wherein the ventilation system is completely incorporated within a removal cover that covers the access opening to the engine compartment, but which nevertheless permits both the influx and discharge of ventilating air.

It is a further object to this invention to provide an improved and simplified ventilating arrangement for a small watercraft of this type wherein the entire ventilation system can be incorporated in a removal hatch cover.

This type of watercraft is normally controlled by a handle bar assembly positioned immediately forwardly of the rider's area and frequently over either the engine compartment or some other auxiliaries which should be accessed for service purposes. However, if a removal hatch cover is employed for this purpose, then it must not only provide the support for the control but also must permit the desired ventilation arrangement.

It is, therefore, a still further object to this invention to provide an improved ventilating hatch cover for a small watercraft that also is capable of carrying the watercraft controls.

As should be readily apparent from the foregoing description, the very compact nature of this type of watercraft gives rise to a number of problems. Some of those have already been mentioned and these include the positioning of the various necessary components for the watercraft and their accessibility. One component which should be positioned so as to be accessible and yet protected, is the fuel tank for containing fuel for the engine. It is, of course, desirable to permit a large fuel storage capacity but the fuel tank must also be such that it can be readily accessible so as to permit refueling.

It is another object to this invention to provide an improved fuel tank and filler arrangement for a small watercraft.

SUMMARY OF THE INVENTION

A first feature of this invention is adapted to be embodied in a hull configuration for a small personal watercraft that is comprised of a bow portion and an underside. The forward part of the bow is generally vertically disposed from an upper gunnel to the lower end thereof. The lower end merges into the underside along a gradual curve to provide a high volume of the hull for floatation within a relatively short length while still directing water away from the upper part of the hull when the watercraft is traveling in the water.

Another feature of the invention is also adapted to be embodied in a hull arrangement for a small watercraft. The hull is comprised of joined deck and lower portions that define at least one cavity with an access opening in the deck for accessing the cavity. A combined cover and ventilation assembly is provided for detachably covering the access opening and ventilating at least part the cavity. The combined cover and ventilation assembly is comprised of a pair of joined members defining therebetween a further cavity. Atmospheric vent means are provided in one of the members for the admission to and discharge of atmospheric air to the further cavity. Circulation means are provided for circulating air between the further cavity and the cavity for ventilating the cavity.

Another feature of the invention is also adapted to be embodied in a hull arrangement for a small watercraft that is comprised of joined deck and lower portions that define at least one forwardly positioned cavity. A fuel tank is positioned in this forward cavity and has a forwardly extending fill opening. A fill neck is mounted on the forward portion of the deck at one side thereof and a flexible pipe interconnects the fill neck with the fuel tank fill opening.

DETAILED DESCRIPTION OF THE PREFERRED EMBODIMENT OF THE INVENTION

Figure 1:
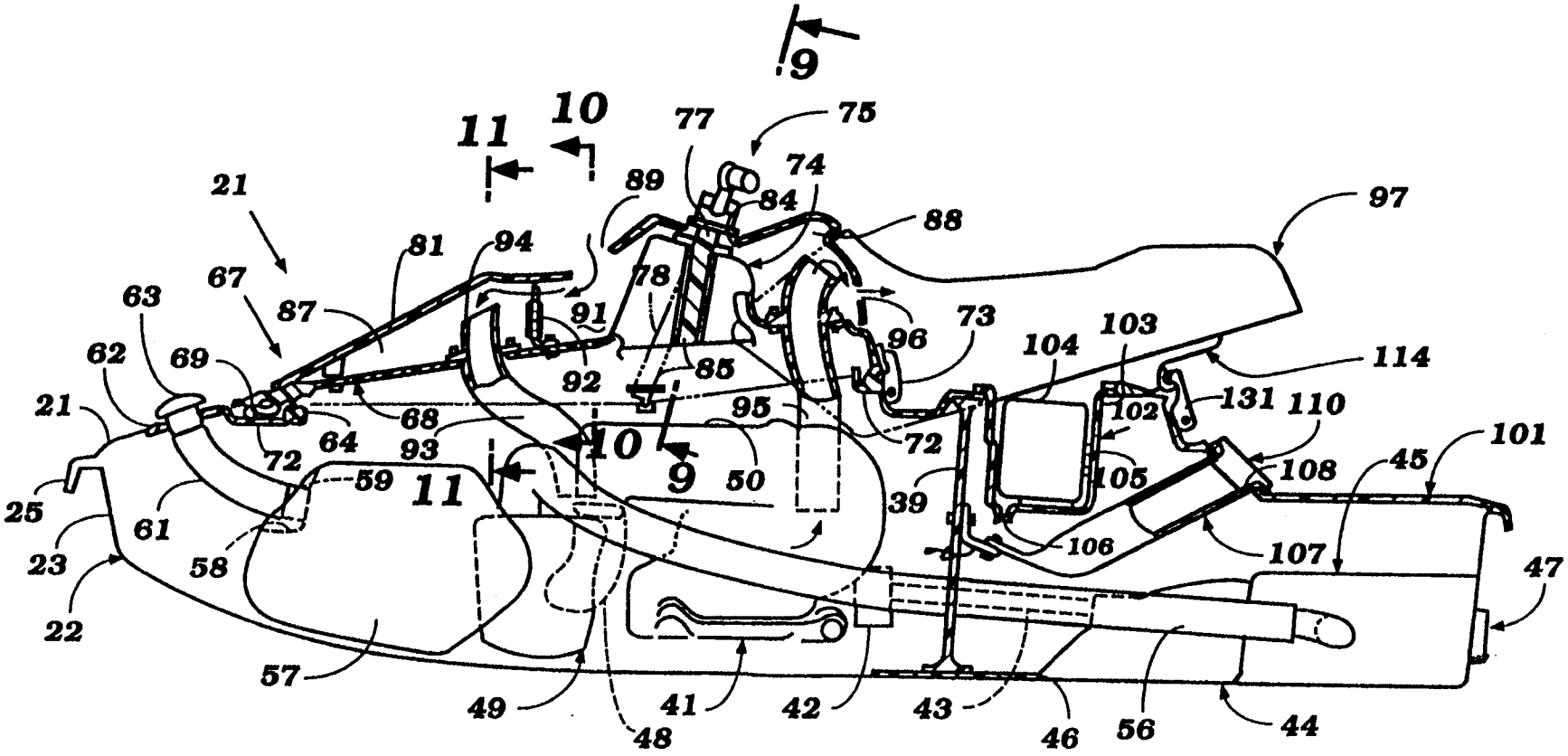
FIG. 1 is a side elevational view of a small personal watercraft constructed in accordance with an embodiment of the invention with certain portions shown in cross section and other portions shown broken away so as to indicate the relationship of the various components.

Referring now in detail to the drawings, a small personal watercraft constructed in accordance with an embodiment of the invention is identified generally by the reference numeral 21. The watercraft 21 is of the same general nature as of the watercraft is the aforenoted co-pending applications with the parent application now being issued as the aforenoted U.S. Pat. No. 5,255,626. Where any details of the construction are not described, reference may be had to that patent, which as have been noted, is incorporated herein by reference. Basically, the watercraft 21 is designed to be operated by a rider in a semi-standing but seated position as described in the aforenoted applications and patent.

The small watercraft 21 is comprised of a hull assembly, indicated generally by the reference numeral 22 having a lower hull portion 23 and an upper deck portion 24 that are secured to each other around their periphery at a gunnel 25. The portions 23 and 24 may be formed from any suitable material such as a molded fiberglass reinforced resin or the like.

The hull portion 23 has a configuration as generally described in the aforenoted co-pending applications and the noted United States Patent, with some differences which will be noted. As noted the hull portion 23 is configured so as to permit leaning while obtaining stability as the watercraft 21 is leaned more than a certain amount so that the watercraft can be ridden similar to a motorcycle. In accordance with the features of this invention, however, the hull portion 23 and its relation to the gunnels 25 is such so as to eliminate or substantially reduce the amount of spray that may issue upwardly and might otherwise obscure the vision of the rider and passengers.

This hull configuration will now be described by particularly reference to FIGS. 2 through 5 and those skilled in the art can readily make a comparison between the construction of this hull and that of the aforenoted earlier applications and determine how this hull, although it embodies the basic features of the hull of the watercraft of the earlier applications, also differs to provide the aforenoted effects. These differences will also be described as the specification proceeds.

Figure 5:
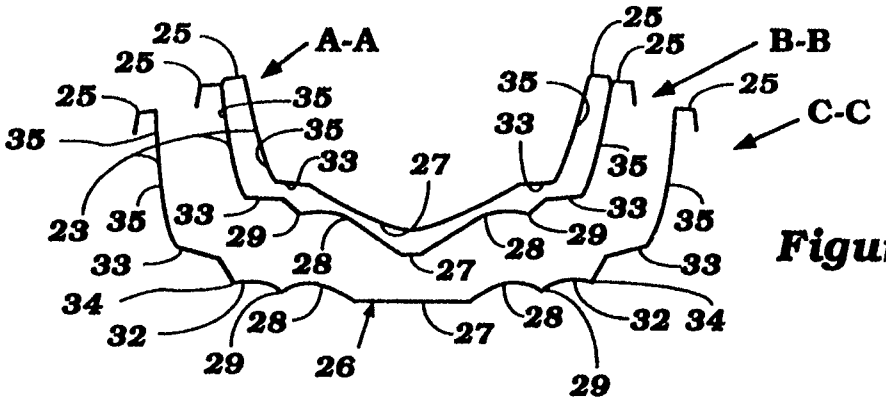
FIG. 5 is a series of cross sectional views taken along the lines A—A, B—B and C—C of FIG. 3 and shows the hull configuration.
Figure 3:
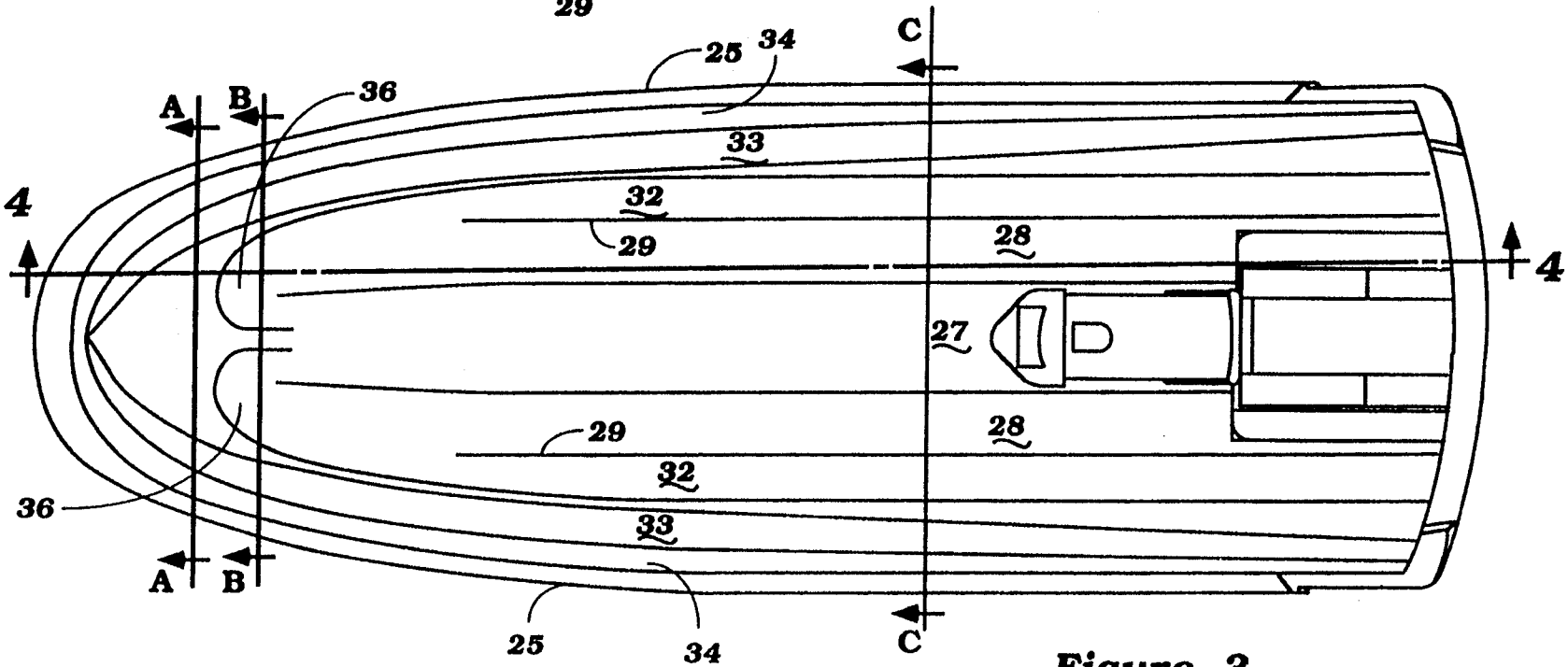
FIG. 3 is a bottom plan view of the hull.

The hull 23 and specifically its underside is formed with a generally flat lower section, indicated generally by the reference numeral 26 which has a flat rear central portion 27 that extends from the rear of the hull portion 23 forwardly with the section 27 assuming some gentle upwardly curved tapper as it approaches the forward or bow end as seen in FIG. 5. On opposite sides of this generally flat central portion 27, there are provided a pair of curved side parts 28 which have a curvature that is steeper at the rear end and which gradually flares out and upwardly as again shown in FIG. 5 as it approaches the bow end. These curved portions 28 terminate at chines 29 that extend forwardly to the forward portion of the hull and are designed so as to lend stability to the watercraft and maintain directional control while still permitting leaning of the watercraft.

Outwardly of the chines 29, the central portion 26 continues on with a pair of additional curved areas 32 which merge toward the bow end of the watercraft into generally horizontally extending steps 33. Normally the steps 33 will be disposed above the water level when the watercraft is traveling in a straight ahead position. Chines 34 are positioned between the curved sections 32 and the steps 33 so as to provide a relatively wide flat area that will offer stability while still having a step up that will accommodate leaning. Generally the dimensional relationship between the hull lower portion and the foot area is as described in the aforenoted co-pending applications and reference may be made to that application for the description of this portion of the hull.

Outwardly of the steps 33, the hull is provided with a pair of generally vertically upstanding side portions 35 which are disposed generally inwardly of the outer periphery of the gunnels 25 so that any water that may be directed upwardly will be deflected back down into the body of water in which the watercraft is operating by the gunnels 25.

Figure 4:
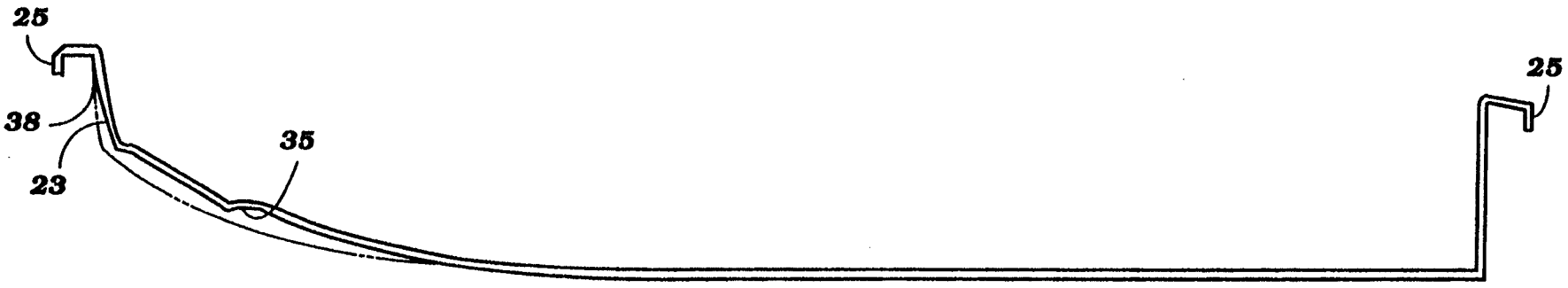
FIG. 4 is a cross sectional view of the hull taken along the line 4—4 of FIG. 3.
Figure 2:
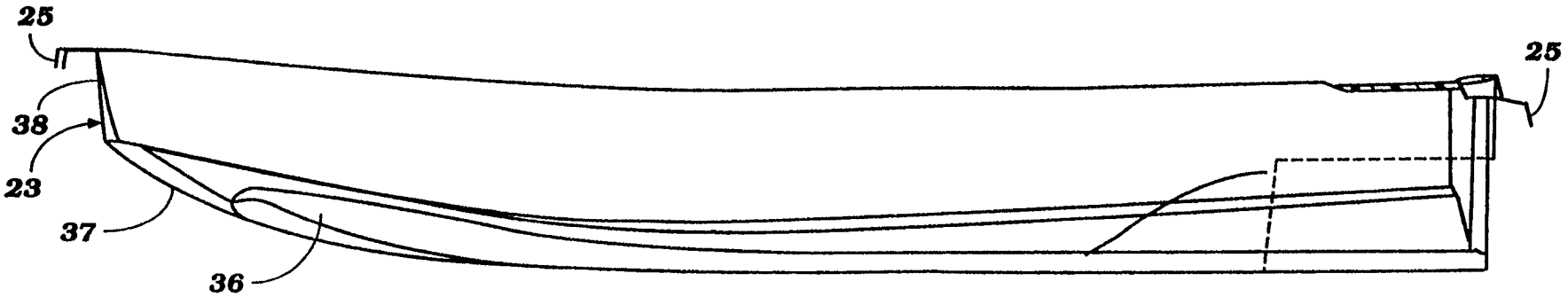
FIG. 2 is a side elevational view of the lower portion of the hull.

It should be noted that the hull portion is provided with a pair of recesses 36 which contain the hull portions 27, 28 and 32 and which terminate somewhat rearwardly of the bow as best seen in FIGS. 2 and 4. From these recesses, the bow has a gently tapered curved portion 37 that merges into a generally vertically extending front portion 38 which is spaced considerably rearwardly of the forward edge of the gunnels 25 so that water which is displaced as the hull passes through the body of water will be directed rearwardly to flow smoothly along the sides of the hull portion 23 without splashing upwardly to obscure the operator or rider's views and also to maintain some degree of dryness for them during the operation. It should be noted from the side elevational view appearing best in FIG. 2 that the vertical height of the curved section 37, when viewed in side elevation, is no greater than the vertical height of the vertical portion 38, so as to provide the desired buoyancy and splash protection.

Thus, from a description of the hull configuration it should be readily apparent that the advantages of the sporting and leaning nature provided for by the hull of the aforenoted co-pending applications and now issued patent are retained, while retaining some control over the way in which the water is discharged and flows back along the sides of the hull rather than being displaced upwardly at the front of the hull so as to create an objectionable splash or spray.

Figure 6:
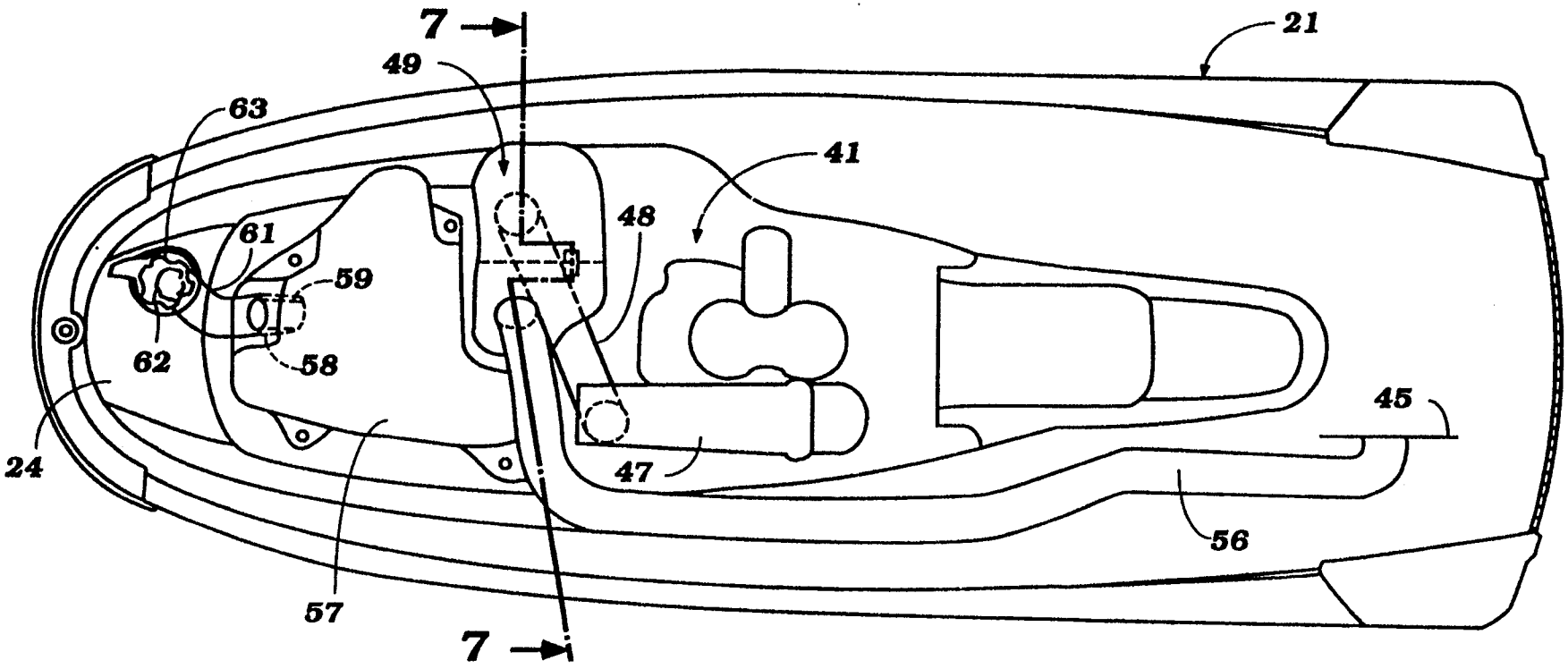
FIG. 6 is a top plan view of the watercraft with portions removed so as to show the layout of the components.
Figure 15:
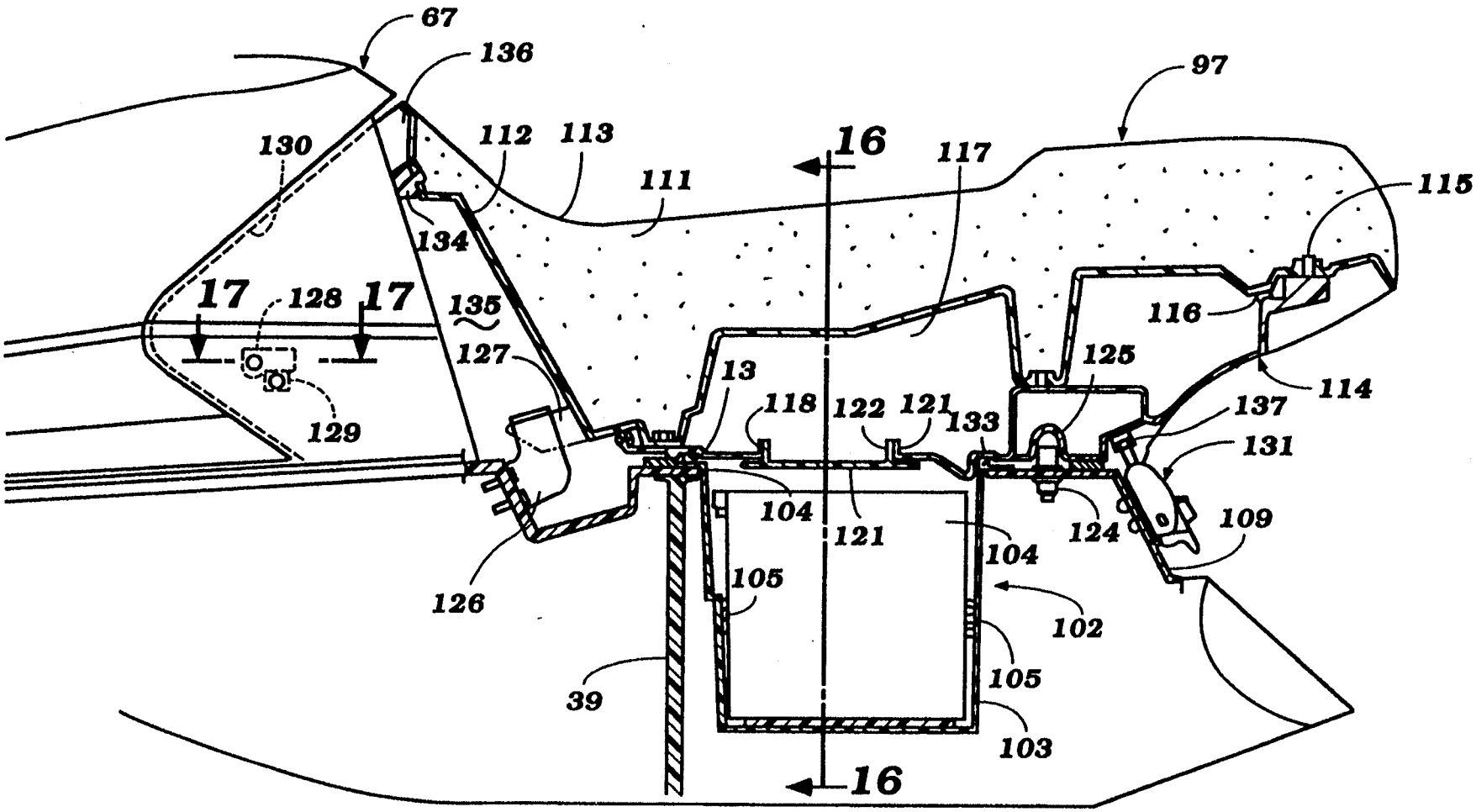
FIG. 15 is an enlarged cross sectional view taken through the seat of the watercraft and shows its relationship to the storage compartment.

Referring now again primarily to FIG. 1 and additionally to FIG. 6, it will be seen that the hull and deck portions 23 and 24 define a generally open cavity or compartment at the front end thereof, the rear portion of which is defined by a bulkhead 39 which may be formed either integrally with the hull portion 23, deck portion 24 or as a separate piece as shown in FIGS. 1 and 15.

An internal combustion engine, indicated generally by the reference numeral 41 is positioned in this cavity and provides the motive power for the watercraft 21. This engine 41 has an output shaft 42 that is coupled to an impeller shaft 43 of a jet propulsion unit, indicated generally by the reference numeral 44 and which is positioned within a tunnel 45 formed in the underside of the rear part of the hull portion 23. The impeller shaft 43 extends through the bulkhead 39 and, as is well known in this art, the jet propulsion unit 44 includes an impeller that draws water through a downwardly facing water inlet opening 46 and discharges it rearwardly through a steering nozzle assembly 47 for propelling and steering the watercraft 21 in a well known manner. The way in which the steering nozzle 47 is controlled will be described later.

Figure 7:
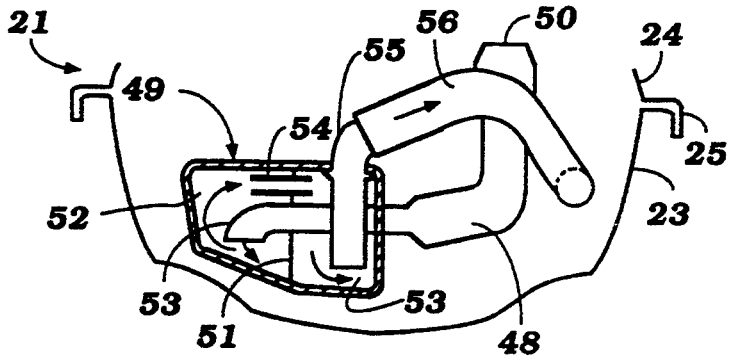
FIG. 7 is a cross sectional view taken along the line 7—7 of FIG. 6 and shows the water trap arrangement for the exhaust system.
Figure 8:
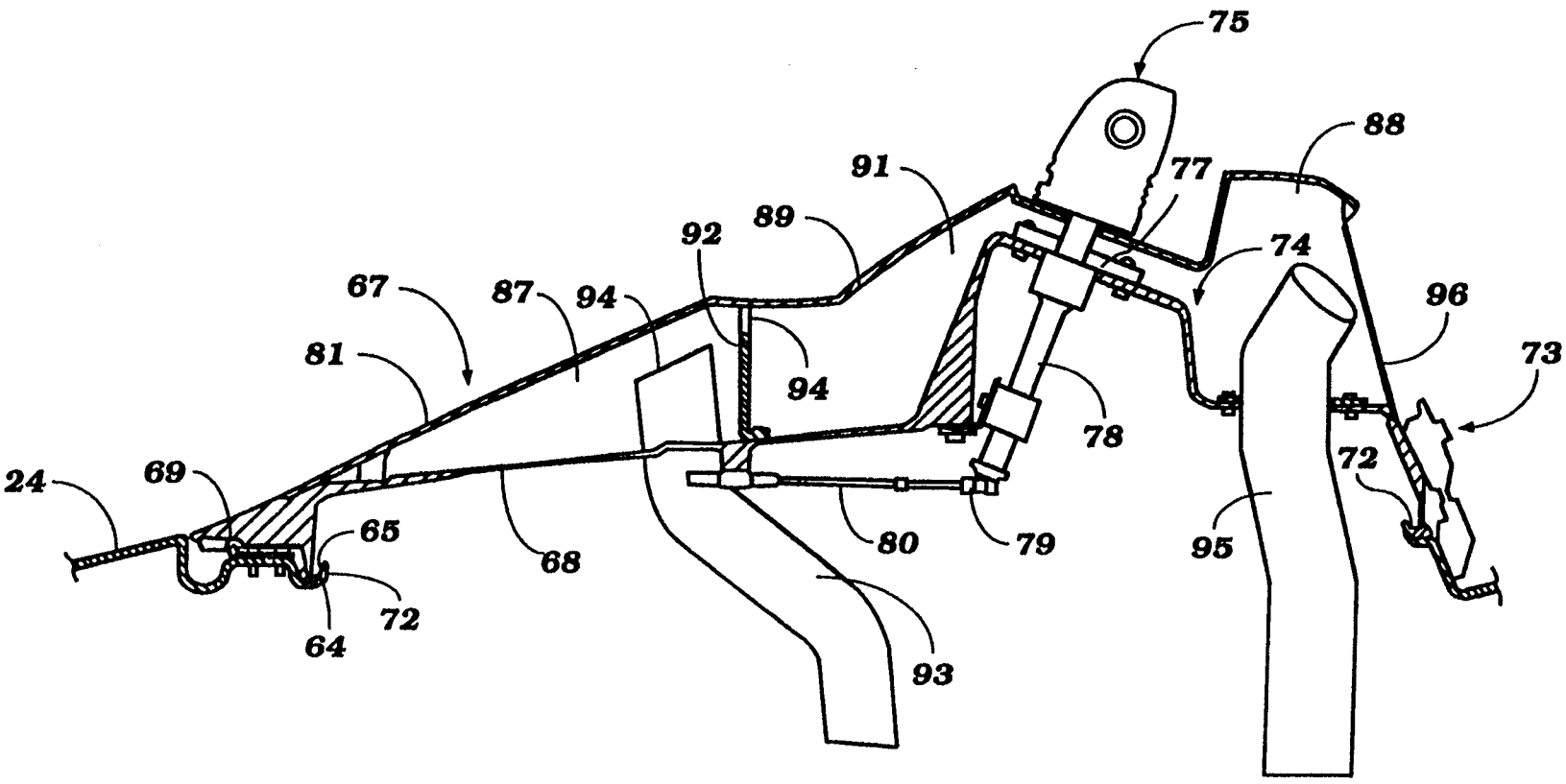
FIG. 8 is an enlarged cross sectional view taken through the removal hatch and ventilation cover and generally shows the similar area of FIG. 1 but on a larger scale.

The engine 41 is, as is typical with marine practice, water cooled by water that is drawn from the body of water in which the watercraft 21 is operating in any well known manner. This coolant is then mixed with the exhaust gases from the engine, for example in an exhaust manifold 50 for silencing of the exhaust gases and cooling them. This water and exhaust is then transferred through a conduit 48 which includes a flexible section to a water trap device, indicated generally by the reference numeral 49 and having a construction as best shown in FIG. 7.

This water trap device 49 is disposed immediately ahead of the engine 41 and is divided by a vertical baffle 51 into a pair of compartments 52 and 53. The exhaust gases and coolant are discharged into the compartment 52 by a discharge end 53 of the conduit 48. One or more passages 54 are formed at the upper end of the baffle 51 and permit the compartment 52 to communicate with the compartment 53. An exhaust discharge pipe 55 depends into the compartment 53 and is connected by means of a flexible conduit 56 to discharge the exhaust gases and the engine coolant back into the water in which the watercraft is operating through the tunnel 45.

The water trap device 49 functions to preclude any water which may either enter the exhaust conduit 56 or the engine coolant to flow back into the engine through its exhaust system if the watercraft becomes inverted. On the other hand, the exhaust trap device 49 functions so as to permit the water in the coolant to be driven back through the exhaust conduit 56 during engine operation. This general overall concept is as well known in the art.

Positioned in the engine compartment or cavity and forwardly of the water trap device 49 is a fuel tank 57. The fuel tank construction appears best in FIGS. 1 and 6 and the fuel tank may be formed from any suitable material. As may be best seen in FIG. 6, the fuel tank 57 extends generally transversely across the forward end of the engine compartment. A recessed portion 58 in the front of the fuel tank 57 is provided with an inlet opening 59 to which a flexible conduit 61 is connected. As may be seen in FIG. 6, the flexible conduit 61 extends forwardly and to one side of the forward portion of the deck 24 where it is connected to a fill neck 62. The fill neck 62 has a detachably connected filler cap 63 that is readily accessible at one side of the watercraft 21 so as to permit ease of filling and an operator may stand upon the deck 24 or at least put his foot upon the deck 24 so as to maintain stability during filling.

In order to afford access to the various components within the cavity or engine compartment and particularly to the engine 41, water trap device 49 and fuel tank 57, the deck portion 24 is provided with an enlarged access opening 64 which is defined, as will be described, by a U-shaped recess 65 in which a seal to be described is provided. This opening 64 is selectively closed by an openable combined hatch cover and ventilation assembly, indicated generally by the reference numeral 67 and which has a construction as may be best understood by reference to FIGS. 1 and 8 through 14 and will now be described by particular reference to those figures.

It should be noted that the engine compartment in addition to being accessible through the opening 64 also should be well ventilated when the opening 64 is closed by the hatch and ventilating cover assembly 67. This is to insure not only that the engine 41 receives a copious amount of air supply for its combustion but also so that the engine can be cooled and so that any fumes which may accumulate in the engine compartment can be purged and discharged to the atmosphere.

To this end, the assembly 67 is comprised of a lower portion 68 which may be formed from any suitable relatively rigid material such as a molded fiberglass reinforced resin or the like. This portion 68 is pivotally connected to the deck 24 at the forward end of the opening 64 by a strap hinge 69. The lower outer periphery of the member 68 is provided with a flange 71 that carried a seal 72 (FIGS. 1 and 9) that sealingly engages the deck 24 recess 65 around the opening 64, as aforenoted, to form a water tight enclosure. A suitable latch assembly 73 is provided on the deck portion 24 at the rear end of the opening 64 so as to detachably lock the cover assembly 67 in its closed position. This latch assembly 73 cooperates with a suitable keeper formed on the cover lower portion 68.

Figure 9:
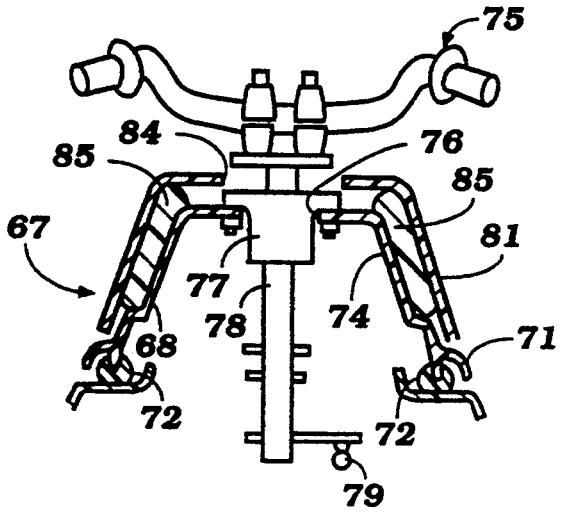
FIG. 9 is a cross sectional view taken along the line 9—9 of FIG. 1.
Figure 10:
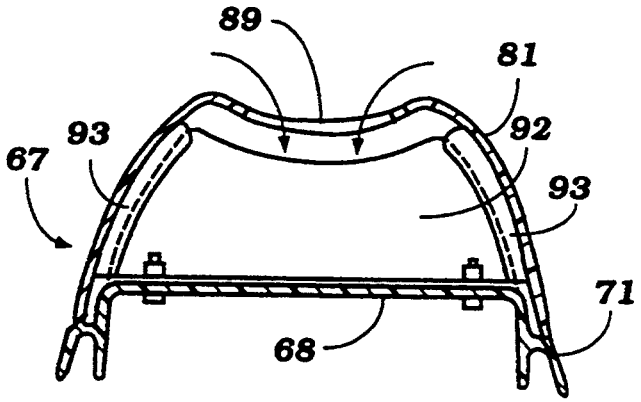
FIG. 10 is a cross sectional view taken along the line 10—10 of FIG. 1 and shows the atmospheric air inlet for the ventilating system.
Figure 11:
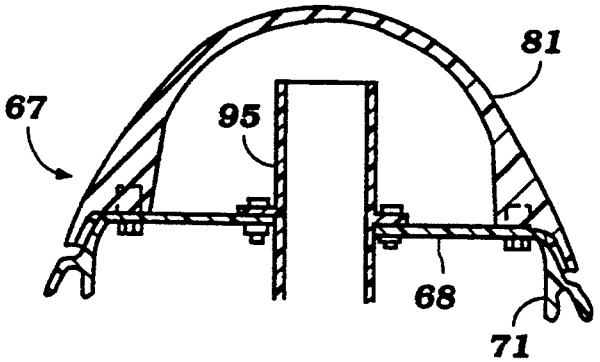
FIG. 11 is a cross sectional view taken along the line 11—11 of FIG. 1 and shows how the air is delivered from the further cavity of the cover and ventilating assembly into the main cavity of the hull.
Figure 12:
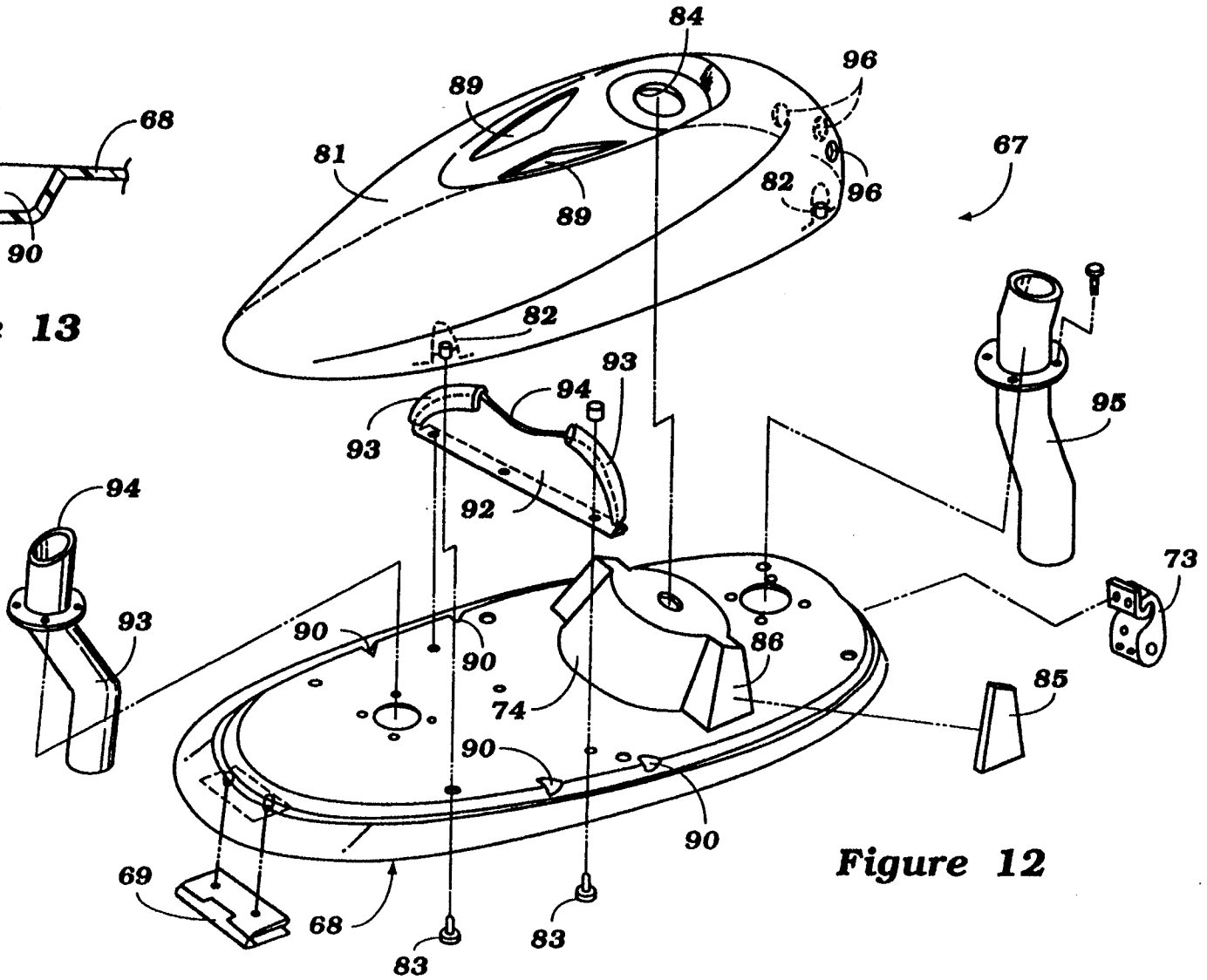
FIG. 12 is an exploded perspective view showing the cover and ventilating assembly.
Figure 13:
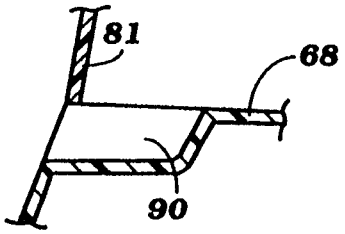
FIG. 13 is an enlarged cross sectional view typical of the water drain portions of the cover and ventilating assembly.
Figure 14:
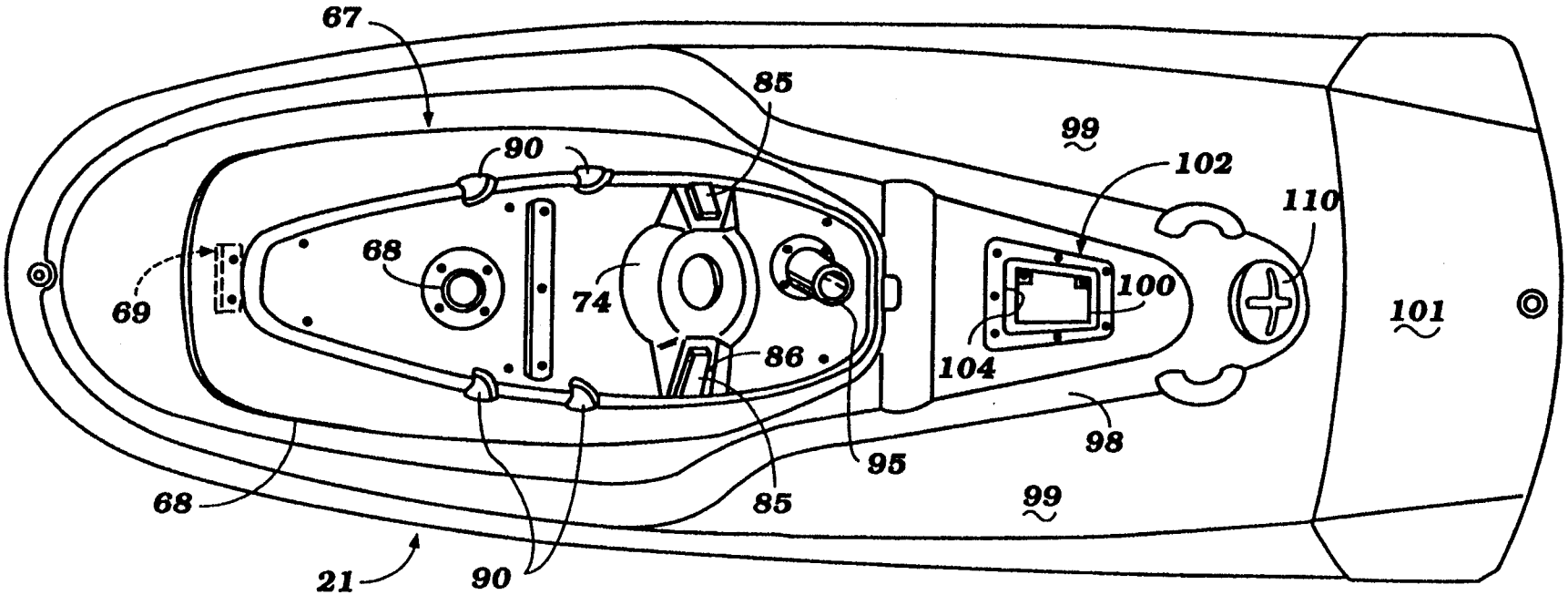
FIG. 14 is a top plan view of the watercraft, in part similar to FIG. 6, but shows the hatch cover in place with the seat and with the upper portion of the cover and ventilating assembly removed.

The lower portion 68 is provided with an enlarged integral steering mast support boss 74 that is formed adjacent its rearward end and which is adapted to support, as best shown in FIG. 9, a handle bar assembly 75. The boss 74 is formed with a central opening 76 that supports a bearing assembly 77 for journalling a steering shaft 78 that is affixed to the handle bar assembly 75 in a well known manner. A connector 79 is affixed to the lower end of the steering shaft 78 and permits attachment of a wire actuator 80 (FIG. 8) that couples the steering mast 78 to the steering nozzle 47 for its steering. By using such a flexible transmitter 80, it is possible to permit the steering mast 75 to pivot along with the coverassembly 67 which it is moved from its closed position as shown in the figures to an open service position.

The cover assembly 67 further includes an upper or second portion 81 which may be formed from a lighter weight material than the lower portion 68 but still may be formed from a molder fiberglass reinforced resinous plastic or the like. The upper portion 81 is formed with a plurality of molded in fasteners 82 that are adapted to receive threaded fasteners 83 (FIG. 12) for fixing the portions 81 and 68 together. As may be seen, the upper portions 81 is formed with an opening 84 that is aligned with the upper end of the mast support boss 74 of the lower portion 68 so as to pass the steering assembly and specifically the shaft 78.

It should be noted that a pair of elastic sealing pads 85 (FIGS. 1, 9, 12 and 14) are positioned on flat sides 86 of the mast support boss 74 and provide a seal with the portion 81 so as to form a pair of further cavities 87 and 88 by the assembly 67 above the engine cavity of the main hull assembly. These further cavities 87 and 88 comprise forward and rearward cavities and are utilized for a ventilation purpose as will now be described.

A pair of nostril like air intake openings 89 are formed in the upper portion 81 forwardly of the steering mast 75. These air intake openings 89 are forwardly facing and hence, ram air will be drawn into these openings 89 as the watercraft 21 moves forwardly in its travel. Air flows through these openings 89 into a rear cavity portion 91 of the cavity 87 formed behind a vertically extending baffle 92 that is carried by the lower portion 68 of the assembly 67. This baffle 92 is provided with side seals 93 that are sealingly engaged with the upper portion 81 but there is provided a recessed area 94 that permits air flow forwardly as shown by the arrows in FIG. 1. This vertical baffle 92 serves a main purpose of assisting in water separation from any air that is inducted through the openings 89.

This air then enters the forward portion of the cavity 87 and will be forced by the pressure of the moving air down into the engine cavity through a ventilating air inlet pipe 93 which is fixed to the lower portion 68. The member 93 has a bevel inlet opening 94 that faces in a forward direction so that the ram air will easily enter it.

Because of the operation of the watercraft in a body of water, there will be large amounts of water present in the air inducted through the openings 89 and the baffle 92 assists in separation of this water. The water thus separated will accumulate on the upper end of the portion 68 and can be freely discharged through a plurality of water drain slots 90 formed in the portion 68 on the front and rear side of the baffle 92. These drain slots 90 appear in most detail in FIG. 13 but they may also be seen clearly in FIGS. 12 and 14.

The air that delivered from the ventilating system as thus far described flows through the engine compartment and that air which is not inducted into the engine 41 for its combustion is discharged vertically upwardly through a ventilating air discharge pipe 95 which is carried by the member 68 and is disposed rearwardly of the steering mast boss 74 and within the discharge compartment 88 formed by the assembly 67. A plurality of rearwardly opening ventilating air discharges 96 are provided in the cover portion 81 and are disposed in somewhat underlying relationship to a seat, to be described, positioned rearwardly of the assembly 67.

It should be noted that the ventilation pipes 93 and 95 extend above the portion 68 into the respective cavities 87 and 88 so that any water accumulation in these cavities cannot flow into the engine compartment. Thus, the system provides a very good ventilation system for the engine compartment while insuring that water cannot accumulate in the engine compartment and will be separated from the ventilating air flow before it is admitted to the engine compartment.

The portion of the deck 24 which defines the opening 64 extends in a generally upward fashion with the cover assembly 67 further providing a raised area which is forwardly of the passenger compartment area which will now be described with particular reference to FIGS. 1 and 14 through 19. This passenger's compartment area accommodates a seat assembly, indicated generally by the reference numeral 97 and which has a construction as will be described.

The seat assembly 97 is configured generally as the seat in the co-pending applications and issued patent and is supported on a raised portion 98 of the deck 24. A pair of foot areas 99 are disposed on opposite sides of the seat assembly 97 so as to accommodate a rider's feet so that the rider can position himself on the seat assembly 97 in a partially standing but sitting position, similar to a rider on a motorcycle. In addition, there is provided a deck area 101 to the rear of the seat assembly 97 and in registry with the foot areas 99 for the reasons as described in the aforenoted co-pending applications and issued patent.

A storage area, indicated generally by the reference numeral 102 is positioned beneath the seat assembly 97. This storage area 102 is comprised of a box-like member 103 that is slipped into an opening 104 formed in the upper portion of the raised portion 98. The storage box 103 may contain an article such as a battery 100 and suitable elastic supports 105 are provided around the battery 100 so as to hold it in position. One or more drain openings 106 (FIG. 1) are provided in the lower portion of the storage box 103 so as to facilitate cleaning and draining of any electrolyte that may be splashed from the battery 110. The drain openings 106 communicates with the tunnel 45 as aforenoted.

The raised portion 98 of the deck 24 also accommodates a further storage tube 107 which has an opening 108 that accessible through a rearwardly extending wall 109 of the raised portion 98 and is closed by means of a closure plug 110. A device such as a flash light, fire extinguisher or the like can be contained within the storage tube 107 and readily accessible by removal of the closure plug 110.

Figure 18:
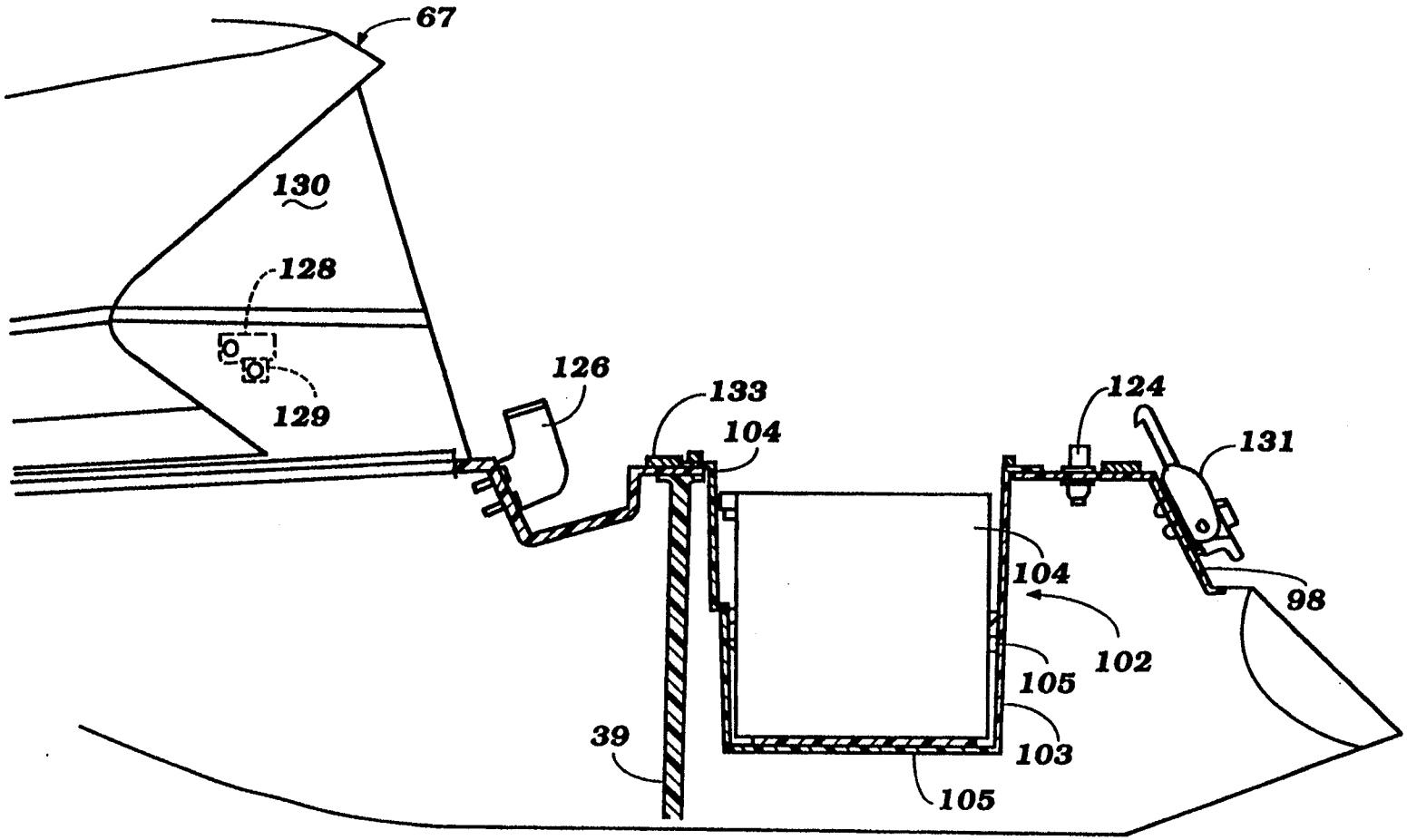
FIG. 18 is a cross sectional view, in part similar to FIG. 15, but shows the seat removed.

The construction of the seat assembly 97 will now be described by particular reference to FIG. 1 and FIG. 15 through 19. The seat assembly 97 is basically a detachable assembly that is readily detachable from the remainder of the watercraft 21 and FIG. 18 shows the appearance when the seat assembly is removed. The seat assembly 97 is, however, itself a single assembly of a number of connected parts so that the seat assembly 97 may be shipped separately and also so that the seat assembly 97 may form a floatation device. The bouyancy seat assembly 97 also avoids complete inversion of the watercraft 21 if it becomes capsized.

Referring now to the figures mentioned, the seat assembly 97 is comprised of a cushion portion 111 that is formed from a foamed plastic or the like which is laid up on a base plate 112 and which is covered by a flexible skin 113.

Affixed to the underside of the base plate 112 is a lower shell, indicated generally by the reference numeral 114 and which may be formed preferably from a relatively rigid material such as a molded fiberglass reinforced resin. A plurality of threaded fasteners 115 affix the lower shell 114 to the base plate 112 with a sealing gasket 116 being interposed therebetween so as to provide a water tight buoyant assembly. The area between the lower shell 114 and the base plate 112 defines a relatively large cavity 117 which, in addition to providing buoyancy, provides a storage area in which articles can be stored. A closure assembly comprised of an access forming member 118 is affixed to an opening 119 in the lower shell and receives a detachable closure plug 121. The closure plug 121 has male threads 122 that cooperate with a female threaded portion 123 of the opening forming member 118 so as to permit ease of access to the storage area 117. As has been noted, the seat assembly 97 is detachably connected to the remainder of the watercraft and the structure that provides this detachable connection will now be described. First, it should be noted that the raised portion 98 of the deck 24 is provided with a pair of locator pins 124 that are adapted to be received in locating recesses 125 formed in the lower shell 114. Forwardly of the storage compartment 102, the deck 24 is provided with a pair of U-shaped receptors 126 that receive forwardly extending keepers 127 that are affixed to the forward portion of the seat underplate 128.

Figure 16:
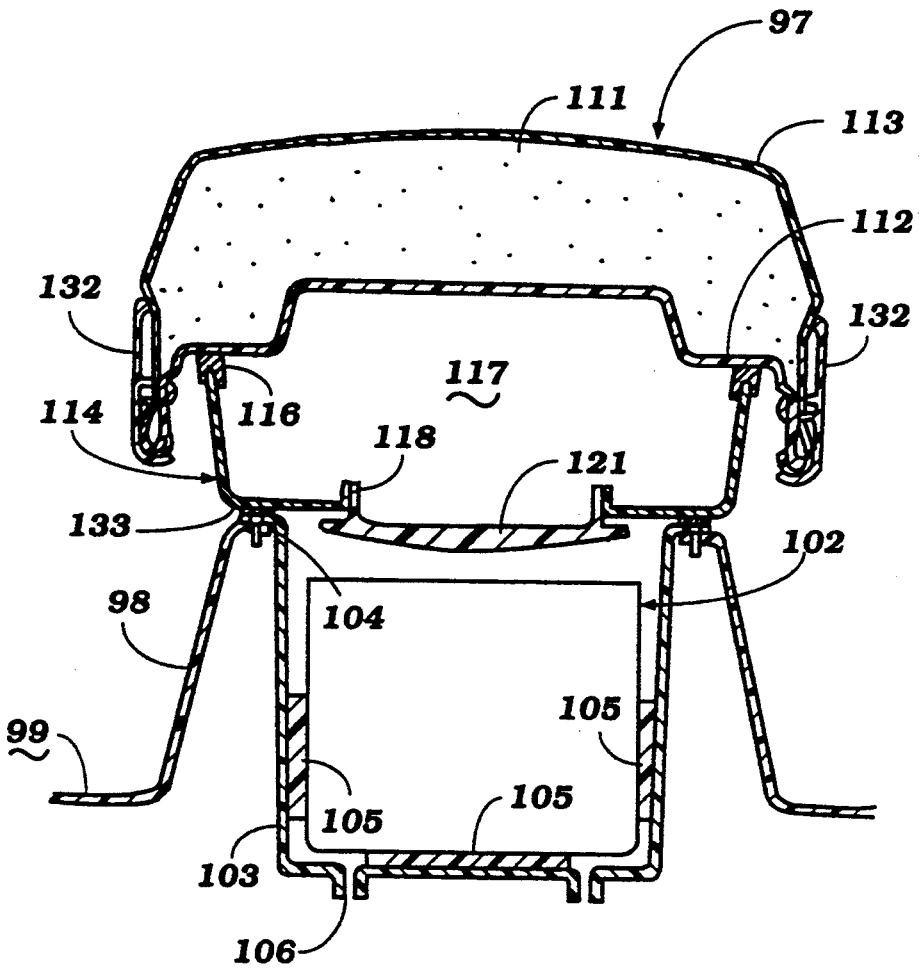
FIG. 16 is a cross sectional view taken long the line 16—16 of FIG. 15.
Figure 17:
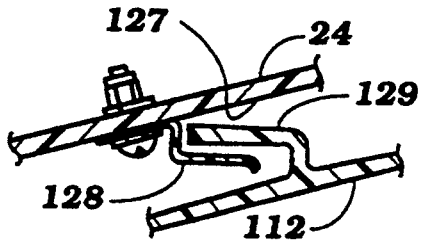
FIG. 17 is a cross sectional view taken along the line 17—17 of FIG. 15 and shows a portion of the construction for holding the seat in position.
Figure 19:
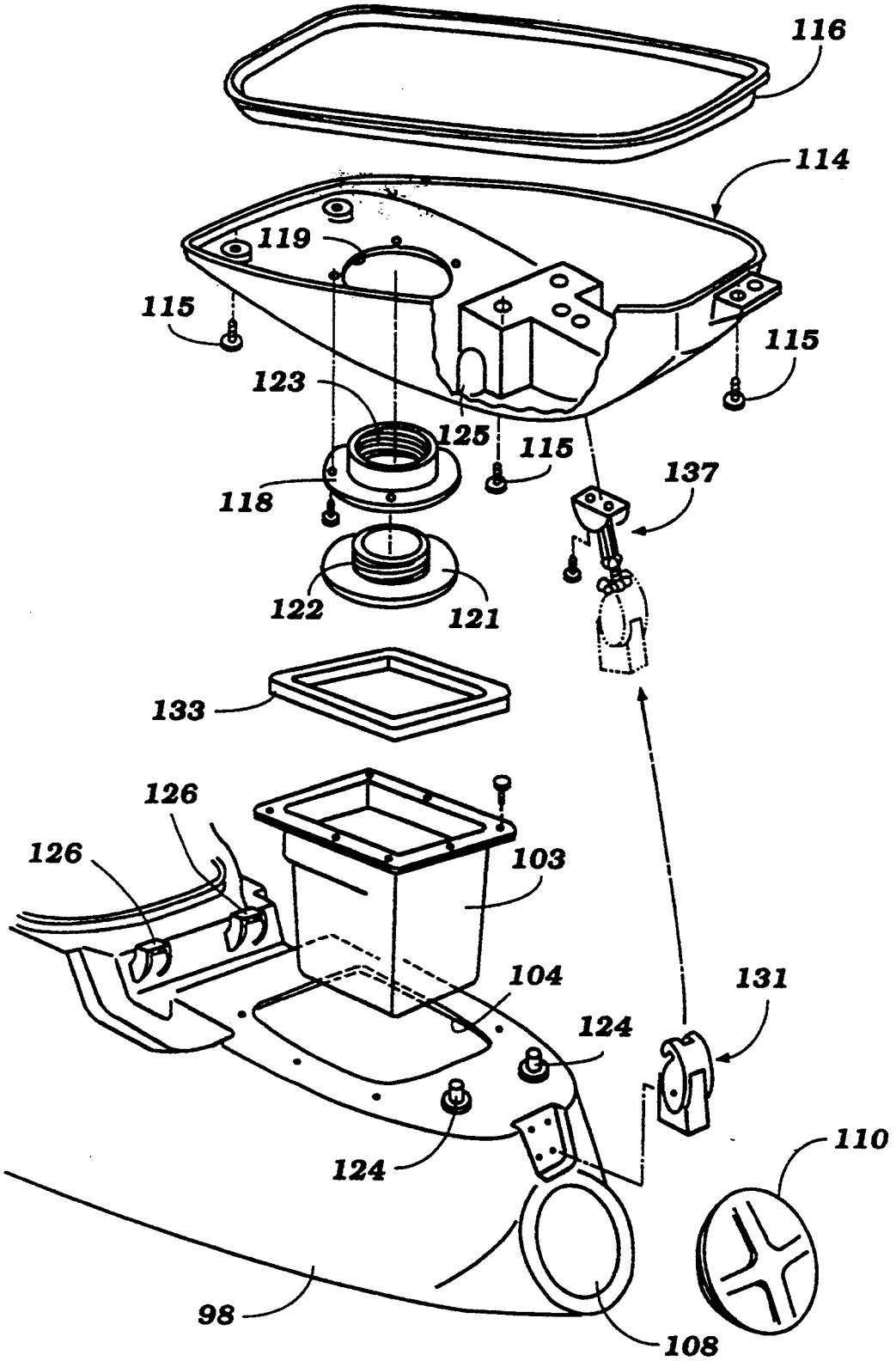
FIG. 19 is an exploded perspective view showing a portion of the seat and the supporting relationship of the watercraft hull.

In addition, the forward portion of the deck is provided with a pair of recesses 130 that receive extending portions of the seat assembly 97 so as to form a neat appearing and continuous side structure. The recessed portions 130 of the deck 24 is provided with a pair of keepers assemblies 128 that receive locating projections 129 of extending portions of the seat and specifically its base plate 112. Further trim pieces 132 may be affixed to the sides of the seat as shown in FIG. 16 so as to further improve the appearance. The final holding of the seat assembly 97 to the watercraft hull is accomplished by means of any form of releasible toggle-type latch 131 that cooperates with a keeper 137 that is affixed to the underside of the lower shell 114 as best seen in FIGS. 15 and 19.

There is also provided a seal 133 that extends around the upper ends of the storage compartment 102 provided in the deck portion 24, so that this storage compartment 102 will be sealed when the seat 97 is locked in place. However, the access to the storage compartment 102 is easily afforded by removal of the seat 97.

As has been previously noted, the ventilating outlets 96 of the ventilating system associated with the cover assembly 67 discharges the ventilating gases beneath the seat assembly 97. The forward end of the seat assembly 97 includes a seal 134 (FIG. 5) that contacts the upper end of the cover assembly 67 when it is in its lowered position. The ventilating gases may be either delivered to a cavity 135 positioned beneath the seal 134 or to a cavity 136 positioned above the seal 134 for discharge to the atmosphere. In either event, the ventilation discharge openings 96 will be shielded and no water is likely to enter into the engine compartment through these openings because of this shielding.

It should be readily apparent from the foregoing description that the described watercraft has a hull configuration that permits the watercraft to be ridden like a motorcycle and leaned like a motorcycle, but which will have high stability and also which will insure against excessive spray being driven upwardly to obstruct the operator's vision or to wet the passengers. In addition, an extremely effective cover and ventilating assembly is provided. Furthermore, an extremely effective and readily accessible fuel tank is provided as is very effective storage and buoyancy arrangment for the watercraft even though it is extremely small. Of course, the foregoing description is that of a preferred embodiment of the invention and various changes and modifications may be made without departing from the spirit and scope of the invention, as defined by the appended claims.

We claim:

1. A hull configuration for a small personal watercraft comprised of a bow portion and an underside, the forward part of said bow portion being generally vertically disposed from an upper end to a lower end thereof, said lower end merging into said underside through a curved section having a gradual curve in side view to provide a high volume for flotation within a relatively short length and to divert water away from the upper part of said hull, the vertical height of said curved section being no greater than the vertical height of said forward part, and a pair of recessed areas extending along the sides of said bow beginning at a point rearwardly of said forward part and from said gradually curved area and continuing along the water line for reducing the upward direction of water along the sides of said hull as said watercraft travels through the body of water.

2. A hull configuration for a small personal watercraft as set forth in claim 1 wherein the low portion of the hull is V-shaped with the V merging at the vertically extending forward part.

3. A hull configuration for a small personal watercraft as set forth in claim 1 wherein the upper end of the bow portion terminates in a forwardly protruding gunnel.

4. A hull configuration for a small personal watercraft as set forth in claim 1 wherein the hull has a pair of side sections which meet at the bow and which extend downwardly to the underside and coextensive in height with said forward part, said underside being comprised of a flat central area and a pair of curved side portions connected at one side to the flat central area by a respective chine and connected at the other side to the lower ends of said side sections by a further chine spaced transversely outwardly thereof.

5. A hull configuration for a small personal watercraft as set forth in claim 4 wherein the hull further has a deck portion with a rider's area to the rear thereof containing a seat and a pair of transversely spaced apart foot areas on opposite sides of said seat to accommodate the feet of a rider, the further chine being spaced transversely outwardly from the foot areas and substantially above said flat central area.

6. A hull configuration for a small personal watercraft as set forth in claim 5 further including a gunnel formed between the deck portion and a lower portion of the hull and extending substantially transversely outwardly therefrom so that the central flat area is disposed inwardly a substantial distance from the gunnel.

7. A hull configuration for a small personal watercraft as set forth in claim 6 wherein the bow portion of the hull is V-shaped with the V merging at the vertically extending forward part.

8. A hull configuration for a small personal watercraft comprised of a bow portion and a underside, the forward part of said bow portion being generally vertically disposed from an upper end to the lower end thereof, said lower end merging into said underside along a gradual curve to provide a high volume for flotation within a relatively short length and to divert water away from the upper part of said hull, said bow portion of said hull being V-shaped with the V merging at the vertically extending forward part, a pair of recessed areas extending along the sides of said bow from said gradually curved area and along the water line for reducing the upward direction of water along the sides of said hull as said watercraft travels through the body of water, the upper end of said bow portion terminating in a forwardly protruding gunnel, said hull being comprised of a joined deck portion and lower portion defining at least one cavity, an access opening formed in said deck portion for accessing said cavity, and a combined cover and ventilation assembly for detachably covering said access opening and ventilating at least in part said cavity, said cover and ventilation assembly being comprised of a pair of joined members defining therebetween a further cavity, atmospheric vent means in one of said members for the admission of and discharge of air from said further cavity, and circulating means for circulating air between said cavity and said further cavity for ventilating said cavity.

9. A hull as set forth in claim 8 wherein the atmospheric vent means comprises a forwardly positioned atmospheric air inlet for admitting atmospheric air into the further cavity and a rearwardly positioned ventillation air discharge for discharging ventillation air from said further cavity.

10. A hull as set forth in claim 8 wherein the circulating means comprises a forwardly positioned inlet opening for circulating air from said further cavity into said cavity and a rearwardly positioned discharge opening for discharging air from said cavity to said further cavity.

11. A hull as set forth in claim 10 wherein the atmospheric vent means comprises a forwardly positioned atmospheric air inlet for admitting atmospheric air into the further cavity and a rearwardly positioned ventillation air discharge for discharging ventillation air from said further cavity.

12. A hull as set forth in claim 8 further including dividing wall means in said cover and ventilation assembly for dividing said further cavity into a forward portion and a rearward portion.

13. A hull as set forth in claim 12 wherein the atmospheric vent means comprises a forwardly positioned atmospheric air inlet for admitting atmospheric air into the further cavity forward portion and a rearwardly positioned ventillation air discharge for discharging ventillation air from the further cavity rearward portion.

14. A hull as set forth in claim 14 wherein the circulating means comprises a forwardly positioned inlet opening for circulating air from said further cavity forward portion into said cavity and a rearwardly positioned discharge opening for discharging air from said cavity to said further cavity rearward portion.

15. A hull as set forth in claim 14 wherein the atmospheric vent means comprises a forwardly positioned atmospheric air inlet for admitting atmospheric air into the further cavity forward portion and a rearwardly positioned ventillation air discharge for discharging ventillation air from the further cavity rearward portion.

16. A hull as set forth in claim 15 further including means for draining water from the further cavity externally of the cavity.

17. A hull as set forth in claim 16 wherein the drain means drains both the forward and rearward portions of the further cavity.

18. A hull as set forth in claim 15 wherein the cover and ventilator assembly is pivotally connected to the hull for movement between an opened position wherein the access opening is opened and a closed position wherein the access opening is closed.

19. A hull as set forth in claim 18 wherein the pivotal connection is disposed at the forward end of the access opening and of the combined cover and ventilator assembly.

20. A hull as set forth in claim 19 further including a fuel tank positioned in the forward end of the cavity and having a forwardly positioned inlet opening, a fill neck positioned on a deck of said hull to one side of the forward end thereof, and flexible conduit means interconnecting said fill neck with said fuel tank inlet opening.

21. A hull as set forth in claim 12 further including steering control means for the watercraft carried by the cover and ventilating assembly.

22. A hull as set forth in claim 21 wherein the steering control means is carried at the upper end of the dividing wall.

23. A hull arrangement for a small watercraft, said hull being comprised of joined deck and lower portions defining at least one cavity, an access opening in said deck portion for accessing said cavity, and a combined cover and ventilating assembly for detachably covering said access opening and ventilating at least in part said cavity, said cover and ventilation assembly being comprised of a pair of joined members defining therebetween a further cavity, atmospheric vent means in one of said members for the admission of and discharge of air from said further cavity, and circulating means for circulating air between said cavity and said further cavity for ventilating said cavity.

24. A hull arrangement for small watercraft as set forth in claim 23 wherein the atmospheric vent means comprises a forwardly positioned atmospheric air inlet for admitting atmospheric air into the further cavity and a rearwardly positioned ventillation air discharge for discharging ventillation air from said further cavity.

25. A hull arrangement for a small watercraft as set forth in claim 23 wherein the circulating means comprises a forwardly positioned inlet opening for circulating air from said further cavity into said cavity and a rearwardly positioned discharge opening for discharging air from said cavity to said further cavity.

26. A hull arrangement for a small watercraft as set forth in claim 25 wherein the atmospheric vent means comprises a forwardly positioned atmospheric air inlet for admitting atmospheric air into the further cavity and a rearwardly positioned ventillation air discharge for discharging ventillation air from said further cavity.

27. A hull arrangement for a small watercraft as set forth in claim 23 further including dividing wall means in said cover and ventilation assembly for dividing said further cavity into a forward portion and a rearward portion.

28. A hull arrangement for a small watercraft as set forth in claim 27 wherein the atmospheric vent means comprises a forwardly positioned atmospheric air inlet for admitting atmospheric air into the further cavity forward portion and a rearwardly positioned ventillation air discharge for discharging ventillation air from the further cavity rearward portion,

29. A hull arrangement for a small watercraft as set forth in claim 27 wherein the circulating means comprises a forwardly positioned inlet opening for circulating air from said further cavity forward portion into said cavity and a rearwardly positioned discharge opening for discharging air from said cavity to said further cavity rearward portion.

30. A hull arrangement for a small watercraft as set forth in claim 29 wherein the atmospheric vent means comprises a forwardly positioned atmospheric air inlet for admitting atmospheric air into the further cavity forward portion and a rearwardly positioned ventillation air discharge for discharging ventillation air from the further cavity rearward portion.

31. A hull arrangement for a small watercraft as set forth in claim 30 further including baffle means interposed in the forward portion of the further cavity and between the atmospheric air inlet and the ventilating air inlet.

32. A hull arrangement for a small watercraft as set forth in claim 31 wherein the ventilating air inlet is formed by a vertically extending tube extending above a lower wall of the further cavity for further assisting in insuring that water will not pass into the cavity from the further cavity.

33. A hull arrangement for a small watercraft as set forth in claim 27 further including means for draining water from the further cavity externally of the cavity.

34. A hull arrangment for a small watercraft as set forth in claim 33 wherein the drain means drains both the forward and rearward portions of the further cavity.

35. A hull arrangement for a small watercraft as set forth in claim 27 further including steering control means for the watercraft carried by the cover and ventilating assembly,

36. A hull arrangement for a small watercraft as set forth in claim 35 wherein the steering control means is carried at the upper end of the dividing wall.

37. A hull arrangement for a small watercraft as set forth in claim 27 further including means for draining water from the further cavity externally of the cavity.

38. A hull arrangement for a small watercraft as set forth in claim 37 wherein the drain means both the forward and rearward portions of the further cavity.

39. A hull as set forth in claim 38 further including a fuel tank positioned in the forward end of said cavity and having a forwardly positioned inlet opening, a fill neck positioned on a deck of said hull to one side of the forward end thereof, and flexible conduit means interconnecting said fill neck with said fuel tank inlet opening.

40. A hull arrangement for a small watercraft as set forth in claim 23 wherein the cover and ventilator assembly is pivotally connected to the hull for movement between an opened position wherein the access opening is opened and a closed position wherein the access opening is closed.

41. A hull arrangement for a small watercraft as set forth in claim 40 wherein the pivotal connection is disposed at the forward end of the access opening and of the combined cover and ventilator assembly.

* * * * *

UNITED STATES PATENT AND TRADEMARK OFFICE

CERTIFICATE OF CORRECTION

PATENT NO. : 5,390,621
DATED : February 21, 1995
INVENTOR(S) : Hattori et al.

It is certified that error appears in the above-identified patent and that said Letters Patent is hereby corrected as shown below:

Column 4,
Line 14, please change "is" to -- in --

Column 8,
Line 24, please change "that" to -- that is --

Column 9,
Lines 9-10, please change "communicates" to -- communicate --

Claim 1,
Line 2, please change "the" to -- a --
Line 9, please change "the upper" to -- an upper --
Line 9, please change "the vertical" to -- a vertical --
Line 10, please change "the" to -- a --
Line 12, please delete "the"
Lines 13 and 14, please change "gradually curved area" to -- gradual curve --
Line 15, please change "reducing the" to -- reducing --

Claim 2,
Line 2, please change "low" to -- bow --

Claim 5,
Line 6, please delete "the" (first occurrence)

Claim 8,
Line 2, please change "a underside" to -- an underside --
Line 2, please change "the" to -- a --
Line 4, please change "the" to -- a --
Line 8, please change "the" to -- an --
Line 11, please delete "the"
Line 12, please change "gradually curved area" to -- gradual curve --
Line 13, please change "the upward" to -- upward --
Line 14, please change "the" to -- a --

Claim 14,
Line 1, please change "14" to -- 12 --

Claim 18,
Line 2, please change "ventilator" to -- ventilation --

UNITED STATES PATENT AND TRADEMARK OFFICE

CERTIFICATE OF CORRECTION

PATENT NO. : 5,390,621
DATED : February 21, 1995
INVENTOR(S) : Hattori et al.

It is certified that error appears in the above-identified patent and that said Letters Patent is hereby corrected as shown below:

Claim 19,
Line 2, please change "the forward" to -- a forward --

Claim 20,
Line 2, please change "the forward" to -- a forward --

Claim 21,
Line 3, please change "ventilating" to -- ventilation --

Claim 23,
Line 5, please change "ventilating" to -- ventilation --

Claim 24,
Line 5, please change "ventillation" to -- ventilation --
Line 6, please change "ventillation" to -- ventilation --

Claim 26,
Line 5, please change "ventillation" to -- ventilation --
Line 6, please change "ventillation" to -- ventilation --

Claim 28,
Line 6, please change "ventillation" to -- ventilation --
Line 7, please change "," to -- . --

Claim 30,
Lines 5 and 6, please change "ventilla- tion" to -- ventilation --
Line 6, please change "ventillation" to -- ventilation --

Claim 31,
Lines 4 and 5, please change "ventilating air inlet" to -- forwardly positioned inlet opening --

Claim 32,
Line 2, please change "ventilating air inlet" to -- forwardly positioned inlet opening --

Claim 35,
Line 4, please change "," to -- . --

Claim 38,
Line 2, please change "means both" to -- means drains both --

UNITED STATES PATENT AND TRADEMARK OFFICE

CERTIFICATE OF CORRECTION

PATENT NO. : 5,390,621
DATED : February 21, 1995
INVENTOR(S) : Hattori et al.

It is certified that error appears in the above-identified patent and that said Letters Patent is hereby corrected as shown below:

Claim 40,
Line 2, please change "ventilator" to -- ventilation --

Claim 41,
Line 3, please change "the forward" to -- a forward --
Line 4, please change "ventilator" to -- ventilation --

Signed and Sealed this

Fifteenth Day of January, 2002

*Attest:*

*Attesting Officer*

JAMES E. ROGAN
*Director of the United States Patent and Trademark Office*